United States Patent [19]

Bates et al.

[11] 3,949,525

[45] Apr. 13, 1976

[54] WINDOW LOCK STRUCTURE

[75] Inventors: Wayne C. Bates; Wilbert C. Wallin, both of Owatonna, Minn.

[73] Assignee: Truth Incorporated, Owatonna, Minn.

[22] Filed: Feb. 28, 1973

[21] Appl. No.: 336,632

[52] U.S. Cl. ..... 49/395; 292/187; 292/140

[51] Int. Cl.[2] ..... E05C 9/02

[58] Field of Search ..... 49/394, 395, 276–278, 49/252; 292/47, 49, 53, 138, 182, 187, DIG. 33, 140

[56] References Cited

UNITED STATES PATENTS

| | | | |
|---|---|---|---|
| 2,022,081 | 11/1935 | Ellison | 49/395 X |
| 2,094,990 | 10/1937 | Lang | 49/395 X |
| 3,085,299 | 4/1963 | Reynand | 49/252 |

*Primary Examiner*—Kenneth Downey

*Attorney, Agent, or Firm*—Wegner, Stellman, McCord, Wiles & Wood

[57] ABSTRACT

A window and lock structure therefor for drawing the window sash tightly against the window frame, with the locking structure including a keeper on the window sash engageable by a locking shoe mounted on the frame and with the locking shoe having compound movement to engage the keeper and draw the sash tightly closed, with the movement of the locking shoe being derived from mechanism actuated by engagement with another part of the window sash as the window sash is closed.

10 Claims, 3 Drawing Figures

15
17
18
16
70
75
2.
21
32
31
30
20a
56
55
23
48
10
45
11
24
49
50
44
85
86
80
40
42
41
20b
43
22
A
2.

WINDOW LOCK STRUCTURE

BACKGROUND OF THE INVENTION

This invention pertains to automatically operable lock structure for a window having a pivotally-mounted window sash with improvements in such mechanism providing for drawing the sash tightly closed against the frame with both closing and lifting forces applied to the sash and with window-operated structure for positively releasing the locking structure.

The known prior art includes the following patents:

| | |
|---|---|
| Lang | 2,036,151 |
| Lang | 2,094,990 |
| Reynaud | 2,157,016 |
| Reynaud | 2,952,882 |
| Reynaud | 3,085,299 |

In the above-listed patents, many different structures are disclosed for drawing a window tightly closed. Some of these mechanisms require a separate manual operator as part of an auxiliary locking structure. Those disclosures which provide for automatic operation of a locking structure in response to closing of the window do not exert the desired forces with the desired mechanical advantage.

SUMMARY

The invention disclosed herein provides an automatic locking structure for a window having a pivotally-mounted window sash, such as a casement window. In such windows, it is conventional to have a window operator to pivot the window sash to a desired position relative to the window frame. In such windows, the sash will tightly abut the window frame or weather stripping carried thereby in the area of location of the window operator. Due to warpage and other factors, it frequently occurs that the part of the window sash remote from the window operator and from the pivotal mounting of the window sash will not tightly engage the window frame. The window locking structure disclosed herein functions to draw in this remote part of the window sash to cause it to tightly abut the window frame.

The closing movement of the sash actuates a linkage to cause a compound movement of a locking shoe to bring it into engagement with a keeper on the sash and with further movement drawing the keeper and sash into tightly closed relation with the window frame while giving a desired lifting action to the window sash to assist in its reaching fully-closed position. In providing this new and improved action, the locking shoe is pivotally-mounted by means of a pin and elongate slot whereby the locking shoe can be given both pivotal and linear movements to coact with the keeper. The keeper has an inclined catch surface and a similarly inclined surface on the locking shoe coacts therewith whereby the elevating component of movement of the locking shoe functions to cam inwardly the window sash and keeper and, at the same time, exert a lifting force on the sash to prevent binding thereof.

An object of this invention is to provide a new and improved automatic locking structure for a window having a pivotally-mounted window sash, with the locking structure being in addition to a conventional operator for the window to tightly close the sash at a location remote from the conventional operator.

Another object of the invention is to provide an automatic locking structure for a window, with a locking shoe mounted on the window frame for compound movement and coaction with a keeper carried on the window sash, actuating mechanism for the locking shoe engageable by the window sash to operate the locking shoe into engagement with the keeper and with further movement of the locking shoe drawing the keeper and window sash into tightly-closed relation with the window frame and with forces derived from the compound movement of the locking shoe exerting both closing and lifting forces on the window sash.

Still another object of the invention is to provide locking structure as defined in the preceding paragraphs wherein the actuating mechanism for the locking shoe is engaged by a strike carried on the window sash, the actuating mechanism includes a toggle linkage which moves to a substantially straight-line position when the window sash is closed, and a catch member on the strike plate which is engageable with an interconnecting pivot pin of the toggle linkage when the window is closed to pull said pivot pin and break the toggle linkage as the window sash opens and with release of this interengagement upon further opening movement of the window sash by said pivot pin travelling in an arcuate path.

DESCRIPTION

Figures 1, 2, 3:
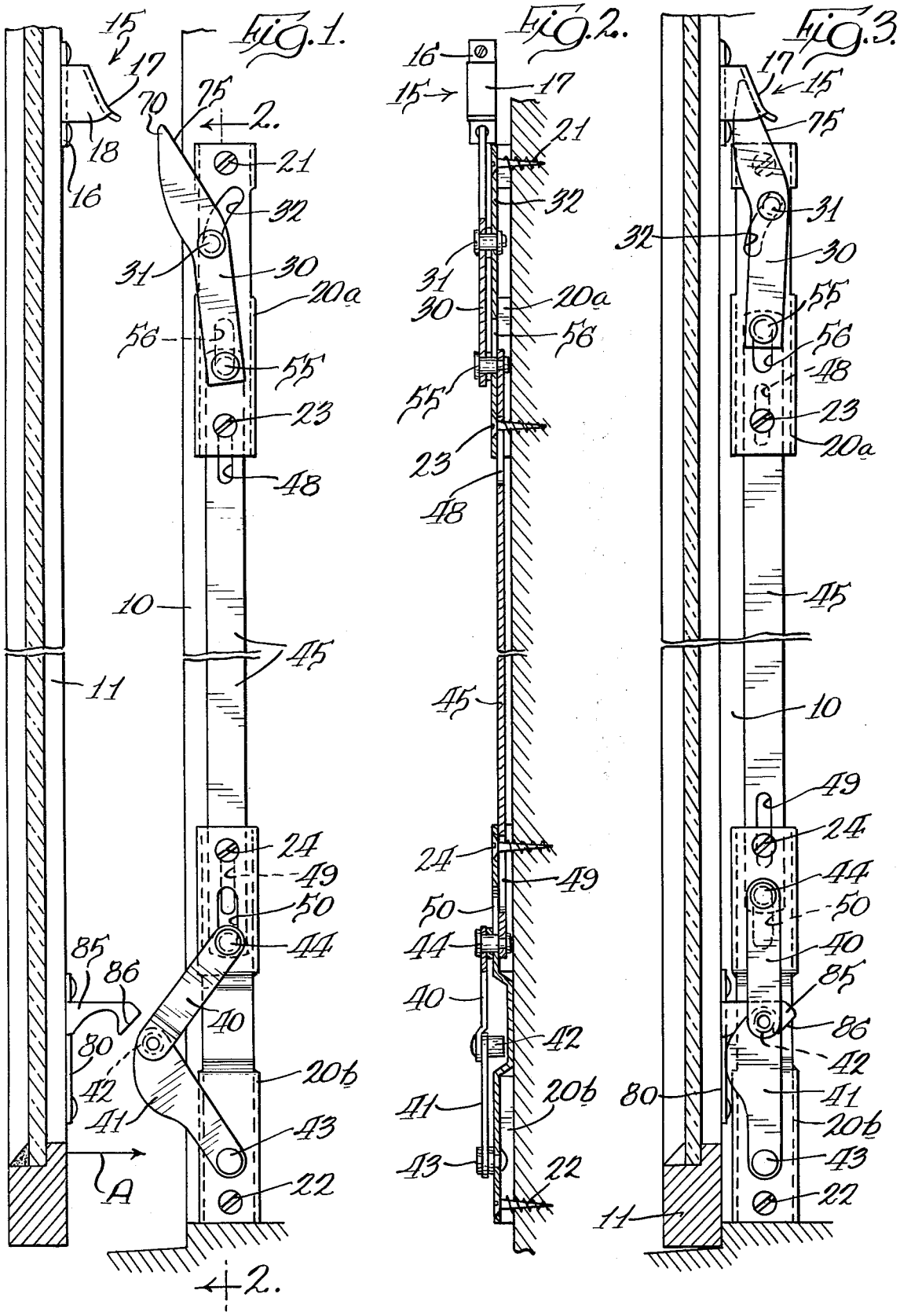
FIG. 1 is a vertical section through a window showing one vertical surface of the window frame in elevation and showing the window sash in section and at a position spaced from the window frame.
FIG. 2 is a vertical section of the window locking structure shown in FIG. 1 and taken generally along the line 2—2 in FIG. 1.
FIG. 3 is a view similar to FIG. 1 showing the window closed with the window sash in abutting relation with the window frame.

The window locking structure is shown in inactive position in FIG. 1 and in window locking position in FIG. 3. The window has a window frame 10 and a window sash 11. The window is of the type wherein the window sash 11 is pivotally-mounted relative to the window frame, such as a casement window.

The window locking structure includes a keeper, indicated generally at 15, having a base 16 attachable by suitable elements, such as screws, to the window sash 11 and having an inclined member 17 with a catch surface spaced from the base by a side wall 18.

The window frame 10 mounts a two-part housing channel **20*a* and 20*b*. The channel parts 20*a* and 20*b* each have vertically extending flanges along a part of their length with the channel part 20*b* having a central part offset to be coplanar with the flanges thereof. The channel parts 20*a* and 20*b* are secured to the window frame 10 by a first pair of mounting screws 21 and 22 and a second pair of mounting screws 23 and 24**, with the latter pair also performing a guide function to be described.

A locking shoe 30 is carried by the window frame 10 and is mounted on the housing channel part **20*a* by means of a pivot pin 31 fitted into a cylindrical opening in the locking shoe 30. The pivot pin 31 is engageable in an arcuate inclined slot 32 in the housing channel part 20*a*. With this mounting, the locking shoe 30 can pivot about the axis of the pivot pin 31 and also move upwardly along a path defined by travel of the pivot pin 31 in the arcuate slot 32, with the result that the locking shoe 30** has compound movement.

Actuating mechanism for the locking shoe includes toggle linkage having a link 40 and a cam link 41 which are interconnected by a pivot pin having an exposed surface 42. The lower end of the cam link 41 is pivotally fixed to the housing channel part 20*b* by a pivot pin 43. The upper end of the link 40 is pivotally connected as by pivot pin 44 to a connecting link 45 extending between the housing channel parts 20*a* and 20*b*. The connecting link 45 is mounted on the housing channel parts for up and down movement by said second pair of mounting screws 23 and 24 which engage in slots 48 and 49, respectively, in the connecting link. The pivot pin 44 interconnecting the link 40 and the connecting link 45 may also move vertically as permitted by its extension through an elongate slot 50 in the housing channel part 20*b*. The upper end of the connecting link 45 is connected to the lower end of the locking shoe 30 by an interconnecting pin 55 with vertical movement relative to the guide channel part 20*b* being permitted by extension of the pin 55 through an elongate slot 56 in the guide channel.

Immediately prior to actuation of the locking mechanism, the window frame 10 and the window sash 11 are in the position shown in FIG. 1. With further movement of the window sash 11 in the direction indicated by the arrow toward closed position, the lower part of the window sash 11 along an edge thereof engages the cam link 41 which tends to straighten the toggle linkage composed of link 40 and cam link 41 with the result that elevating movement is imparted to the connecting link 45. This elevating movement is transmitted to the locking shoe 30 with an upper end 70 of the locking shoe entering into the keeper 15 through the open bottom thereof to be positioned behind the inclined catch surface of the member 17. The movement of the window sash 11 to closed position continues until the position of FIG. 3 is reached wherein the toggle linkage has gone to a substantially straight-line relation and the locking shoe 30 is fully elevated with the upper end 70 located behind the catch surface 17. During the movement to the position shown in FIG. 3, the locking shoe will be both elevated and rotated and also moved from left to right. These movements, along with the coincident inclined camming surfaces of the keeper 15 and the surface 75 of the locking shoe 30, cause an inward movement of the keeper with a lifting force applied to the window sash 11. This lifting force is of assistance since frequently a pivoted window, such as a casement window, will have a slight tendency to sag and thus prevent its moving to fully-closed position.

Although the cam link 41 may be directly engaged by the window sash 11, it is preferred to use a strike plate 80 which provides wear surface for engaging the cam link 41. The toggle linkage of the actuating mechanism is in a substantially straight-line relation when the window is closed and as shown in FIG. 3. To assure that the locking structure will move to inactive position, the strike plate has a catch member 85 extending outwardly therefrom with a hook 86 at the end thereof engageable with the enlargement 42 of the pivot pin for the toggle linkage. As the window sash 11 opens, the hook 86 will pull on the pivot pin enlargement 42 to move the toggle linkage out of its straight-line relation. This interconnection is self-releasing since continued outward movement of the window sash 11 permits the toggle linkage to move to the position of FIG. 1 wherein the pivot pin for the toggle linkage moves on a downward arc out of engagement with the hook 86. Once the straight-line relation of the toggle linkage has been broken, the weight of the parts is sufficient to restore the lock structure to the inactive position shown in FIG. 1.

It will be obvious that the lock structure can be horizontally disposed if desired, with a spring for return of the parts to inactive position and that the locking shoe structure could be carried by the window sash.

We claim:

1. A lock structure for a window having a frame and a pivotally-mounted sash comprising, a keeper mounted on one of said frame and sash, a locking shoe carried by the other of said frame and sash for locking engagement with said keeper when the window is closed, said locking shoe being offset from the keeper when the window is open, means mounting said locking shoe for both bodily elevation and rotation to move into engagement with the keeper and draw the sash to closed position as the window closes, the means actuable by the window as the window closes to operate said locking shoe.

2. A lock structure as defined in claim 1 wherein said locking shoe and keeper have interengaging surfaces which exert a lifting force on the sash as it closes.

3. A lock structure as defined in claim 2 wherein the means mounting the locking shoe for compound movement includes a coacting elongate slot and pivot pin with said slot being inclined in a direction to move the pivot pin and locking shoe in a window-closing direction.

4. A lock structure as defined in claim 1 wherein said actuable means includes a toggle linkage movable to a straight-line relation, a strike plate on one of said frame and sash, and means on the strike plate for pulling the toggle linkage out of said straigh-line relation as the window opens.

5. A lock structure as defined in claim 4 wherein said toggle linkage includes a link and a cam link interconnected by a pivot pin with the cam link engageable by the strike plate, and said means on the strike plate includes a catch member engageable with the pivot pin when the window is closed and separable therefrom on opening movement of the window by said pivot pin moving away along an arcuate path.

6. A window having a frame and a movable sash and lock structure for tightly closing a part of the sash against the frame automatically in response to closing movement of the sash comprising, a keeper mounted on the sash and having an inclined catch surface, a housing mounted on the frame, a locking shoe mounted on the housing for bodily movement by a pivot pin floatingly mounted in an elongate slot, and actuable means engageable by the sash including a vertically movable link pivoted to the locking shoe for moving said locking shoe both upwardly into position behind the catch surface to exert a lift force on the sash and laterally to have the interengaged locking shoe and catch surface move in a direction to draw the sash tightly closed.

7. A window as defined in claim 6 wherein the elongate slot is formed in said housing and is inclined upwardly in a direction whereby upward movement of the pivot pin in the slot draws the locking shoe and keeper in a window-closing direction.

8. A window as defined in claim 7 wherein the locking shoe has an inclined surface coincident with that of the keeper and both surfaces are downwardly and inwardly inclined whereby the elevation component of movement of the locking shoe adds to the rate of closing movement of the sash and said sash has a lifting force applied thereto.

9. A lock structure as defined in claim 6 wherein said actuable means includes a toggle linkage movable to a straight-line relation, a strike plate on said sash, and means on the strike plate for pulling the toggle linkage out of said straight-line relation as the window opens.

10. A lock structure as defined in claim 9 wherein said toggle linkage includes a link and a cam link interconnected by a pivot pin with the cam link engageable by the strike plate, and said means on the strike plate includes a catch member engageable with the pivot pin when the window is closed and separable therefrom on opening movement of the window by said pivot pin moving away along an arcuate path.

* * * * *